US005826714A

United States Patent [19]

Martin

[11] Patent Number: 5,826,714

[45] Date of Patent: Oct. 27, 1998

[54] INFANT CARE BAG

[76] Inventor: Melissa A. Martin, 3895 County Rd., 26, Blountsville, Ala. 35031

[21] Appl. No.: 918,049

[22] Filed: Aug. 25, 1997

[51] Int. Cl.[6] ..... B65D 69/00; B65D 771/00

[52] U.S. Cl. ..... 206/232; 206/545; 206/459.5; 206/111; 206/106; 190/111; 150/106

[58] Field of Search ..... 206/232, 545, 206/541, 549, 548, 459.5, 581, 823; 190/111, 109, 102, 108; 150/111, 106, 113; 40/642, 661, 339; 383/40

[56] References Cited

U.S. PATENT DOCUMENTS

| | | | |
|---|---|---|---|
| 3,915,304 | 10/1975 | Pasco et al. | 206/545 |
| 4,228,908 | 10/1980 | Tweeton | 215/11 C |
| 4,598,746 | 7/1986 | Rabinowitz | 150/52 R |
| 4,640,392 | 2/1987 | Decker, Jr. et al. | 190/108 |
| 4,679,242 | 7/1987 | Brockhaus | 383/4 |
| 5,005,679 | 4/1991 | Hjelle | 190/110 |
| 5,022,528 | 6/1991 | Savoy | 206/545 |

*Primary Examiner*—Paul T. Sewell
*Assistant Examiner*—Trinh Nguyen
*Attorney, Agent, or Firm*—Joseph N. Breaux

[57] ABSTRACT

An infant care bag that includes a primary bag assembly and at least one detachable formula case assembly that is detachably securable to the primary bag assembly. The primary bag assembly includes a diaper bag, an accordion fold safety card folder, a number of safety instruction/first-aid cards and a flexible safety card tether. The diaper bag includes a safety card storage pocket formed therein. The accordion fold safety card folder is sized to fit within the safety card storage pocket when in a folded configuration. The flexible safety card tether is secured between the accordion fold safety card folder and the diaper bag. The at least one detachable formula case assembly is detachably securable to the diaper bag. Each detachable formula case assembly has a case member and a removable anti-bacterial formula bottle enclosure. The removable anti-bacterial formula bottle enclosure is constructed from an anti-bacterial plastic and includes a top section and a bottom section. The top section includes a cylinder shaped top receiving cavity and two finger indentations that define a handle of the top section. The bottom section of the removable anti-bacterial formula bottle enclosure includes a cylinder shaped bottom, receiving cavity.

20 Claims, 2 Drawing Sheets

INFANT CARE BAG

TECHNICAL FIELD

The present invention relates to devices for infant care and more particularly to an infant care bag that includes a primary bag assembly and at least one detachable formula case assembly that is detachably securable to the primary bag assembly; the primary bag assembly including a diaper bag, an accordion fold safety card folder, a number of safety instruction/first-aid cards and a flexible safety card tether; the diaper bag including handles, a diaper compartment and a safety card storage pocket formed therein; the accordion fold safety card folder being sized to fit within the safety card storage pocket when in a folded configuration and including a number of safety card sleeves sized to receive therein one of the number of safety instruction/first-aid cards; each of the safety instruction/first-aid cards being positioned within a safety card sleeve of the accordion fold safety card folder; the flexible safety card tether being secured between the accordion fold safety card folder and the diaper bag; the at least one detachable formula case assembly being detachably securable to the diaper bag; each detachable formula case assembly having a case member and a removable anti-bacterial formula bottle enclosure; the case member defining a formula enclosure receiving chamber and having a case cover flap positionable in a manner to block access into the formula enclosure receiving chamber; the removable anti-bacterial formula bottle enclosure being constructed from an anti-bacterial plastic and sized to fit within the formula enclosure receiving chamber of the detachable formula case; the anti-bacterial formula enclosure including a top section and a bottom section; the top section including a cylinder shaped top receiving cavity and two finger indentations that define a handle of the top section; the bottom section of the removable anti-bacterial formula bottle enclosure including a cylinder shaped bottom receiving cavity.

BACKGROUND ART

Infants are often left with relatives or baby sitters while the parents enjoy an evening out. Typically, when an infant is left with a relative or baby sitter a bag with all of the infant's supplies accompanies him. In addition, the parents leave a list of phone numbers and tell the baby sitter what to do in case of an emergency. However, more often than not parents forget or provide incomplete instructions on what to do in case of an emergency. It is also true that many baby sitters do not have the knowledge to perform first aid procedures which may be required in an emergency.

It would be a benefits, therefore, to have an infant care bag that includes an infant's medical history and important medical information. It would be a further benefit, to have an infant care bag that provides first aid procedures on safety cards. It would be an additional benefit to have the safety cards connected to the bag so that the information is always readily accessible.

Additionally, it is often necessary to carry a supply of infant formula in addition to diaper supplies when traveling or otherwise away from home with a toddler or infant. Although the infant formula must be carried, it is often undesirable to carry the infant formula within a diaper bag because of the danger of bacterial contamination. It would be a benefit, therefore, to have a infant care bag having a diaper compartment as well as an anti-bacterial formula enclosure constructed from an anti-bacterial plastic and having a cavity within which a supply of infant formula could be carried.

GENERAL SUMMARY DISCUSSION OF INVENTION

It is thus an object of the invention to provide an infant care bag that has a bag for carrying infant supplies.

It is a further object of the invention to provide an infant care bag that has a plurality of safety cards having emergency information printed thereon attached to the bag.

It is a still further object of the invention to provide an infant care bag that has safety cards including a plurality of procedure card members having a first and second side, the first side of each procedure card member having a first aid procedure printed thereon for an infant under the age of one year, and the second side of each procedure card member having a first aid procedure printed thereon for a child between the age of one year and eight years.

It is a still further object of the invention to provide an infant care bag that has safety cards including an information card member having a first and second side surfaced for writing thereon information pertinent for the child's care.

It is a still further object of the invention to provide an infant care bag that includes a diaper compartment as well as an anti-bacterial formula enclosure constructed from an anti-bacterial plastic, the formula enclosure having a cavity within which a supply of infant formula can be positioned.

It is a still further object of the invention to provide an infant care bag that includes a primary bag assembly and at least one detachable a formula case assembly that is detachably securable to the primary bag assembly; the primary bag assembly including a diaper bag, an accordion fold safety card folder, a number of safety instruction/first-aid cards and a flexible safety card tether; the diaper bag including handles, a diaper compartment and a safety card storage pocket formed therein; the accordion fold safety card folder being sized to fit within the safety card storage pocket when in a folded configuration and including a number of safety card sleeves sized to receive therein one of the number of safety instruction/first-aid cards; each of the safety instruction/first-aid cards being positioned within a safety card sleeve of the accordion fold safety card folder; the flexible safety card tether being secured between the accordion fold safety card folder and the diaper bag; the at least one detachable formula case assembly being detachable securable to the diaper bag; each detachable formula case assembly having a case member and a removable anti-bacterial formula bottle enclosure; the case member defining a formula enclosure receiving chamber and having a case cover flap positionable in a manner to block access into the formula enclosure receiving chamber; the removable anti-bacterial formula bottle enclosure being constructed from an anti-bacterial plastic and sized to fit within the formula enclosure receiving chamber of the detachable formula case; the anti-bacterial formula enclosure including a top section and a bottom section; the top section including a cylinder shaped top receiving cavity and two finger indentations that define a handle of the top section; the bottom section of the removable anti-bacterial formula bottle enclosure including a cylinder shaped bottom receiving cavity.

It is a still further object of the invention to provide an infant care bag that accomplishes some or all of the above objects in combination.

Accordingly, an infant care bag is provided. The infant care bag includes a primary bag assembly and at least one detachable formula case assembly that is detachably securable to the primary bag assembly; the primary bag assembly including a diaper bag, an accordion fold safety card folder, a number of safety instruction/first-aid cards and a flexible safety card tether; the diaper bag including handles, a diaper compartment and a safety card storage pocket formed therein; the accordion fold safety card folder being sized to fit within the safety card storage pocket when in a folder configuration and including a number of safety card sleeves sized to receive therein one of the number of safety instruction/first-aid cards; each of the safety instruction/first-aid cards being positioned within a safely card sleeve of the accordion fold safety card folder; the flexible safety card tether being secured between the accordion fold safety card folder and the diaper bag; the at least one detachable formula case assembly being detachably securable to the diaper bag; each detachable formula case assembly having a case member and a removable anti-bacterial formula bottle enclosure; the case member defining a formula enclosure receiving chamber and having a case cover flap positionable in a manner to block access into the formula enclosure receiving chamber; the removable anti-bacterial formula bottle enclosure being constructed from an anti-bacterial plastic and sized to fit within the formula enclosure receiving chamber of the detachable formula case; the anti-bacterial formula enclosure including a top section and a bottom section; the top section including a cylinder shaped top receiving cavity and two finger indentations that define a handle of the top section; the bottom section of the removable anti-bacterial formula bottle enclosure including a cylinder shaped bottom receiving cavity.

The primary bag member may be constructed of vinyl, plastic, cloth or canvas. Preferably, the primary bag member is water resistant. The primary bag member defines a diaper storage chamber for carrying infant supplies. The diaper storage chamber may have partitions forming separate compartments if desired.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
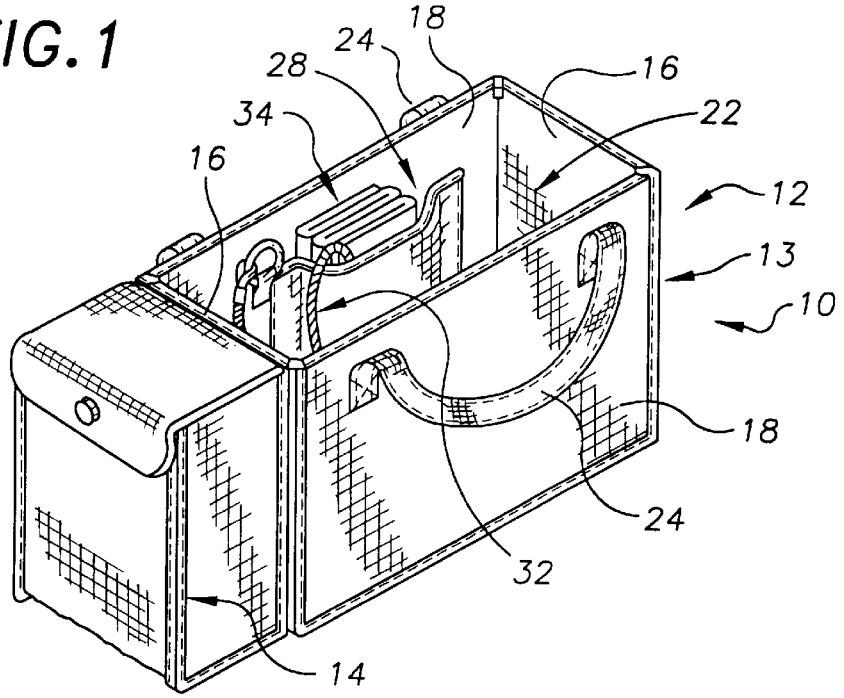
FIG. 1 is a perspective view of a first exemplary embodiment of the infant care bag of the present invention showing the primary bag assembly with the diaper compartment, the handles, the safety card storage pocket, the accordion fold safety card folder, and the flexible safely card tether; and one exemplary embodiment of the detachable formula case.

FIG. 1 shows an exemplary embodiment of the infant care bag of the present invention generally designated by the numeral 10. In this embodiment, infant care bag 10 includes a primary bag assembly, generally designated 12; and one detachable formula case 14, generally designated 14.

Figure 7:
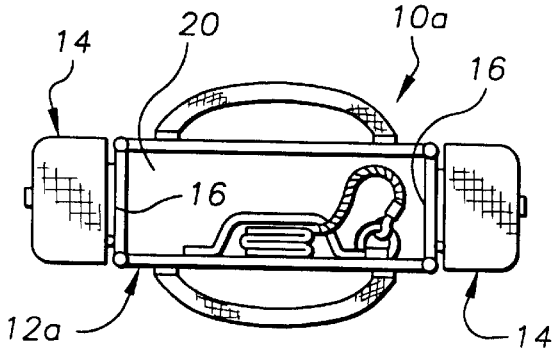
FIG. 7 is a top plan view of the primary bag assembly of the infant carry bag of FIG. 1 with one of the detachable formula cases of FIG. 3 attached to each shorter side end thereof and the accordion fold safety card folder stored in the safety card storage pocket.

Primary bag assembly 12 includes a diaper bag 13 having a pair of opposed end wall panels 16, a pair of opposed side wall panels 18 and a bottom wall panel 20 (FIG. 7). Side wall panels 18, end wall panels 16 and bottom wall panel 20 are formed of canvas and are fastened together by stitching to form a diaper storage chamber 22. A cloth strap 24 is attached by stitching to the exterior surface of each side wall panel 18. An interior panel 26 is stitched to the interior surface of a side wall panel 18 to form a safety card storage pocket 28.

Figure 2:
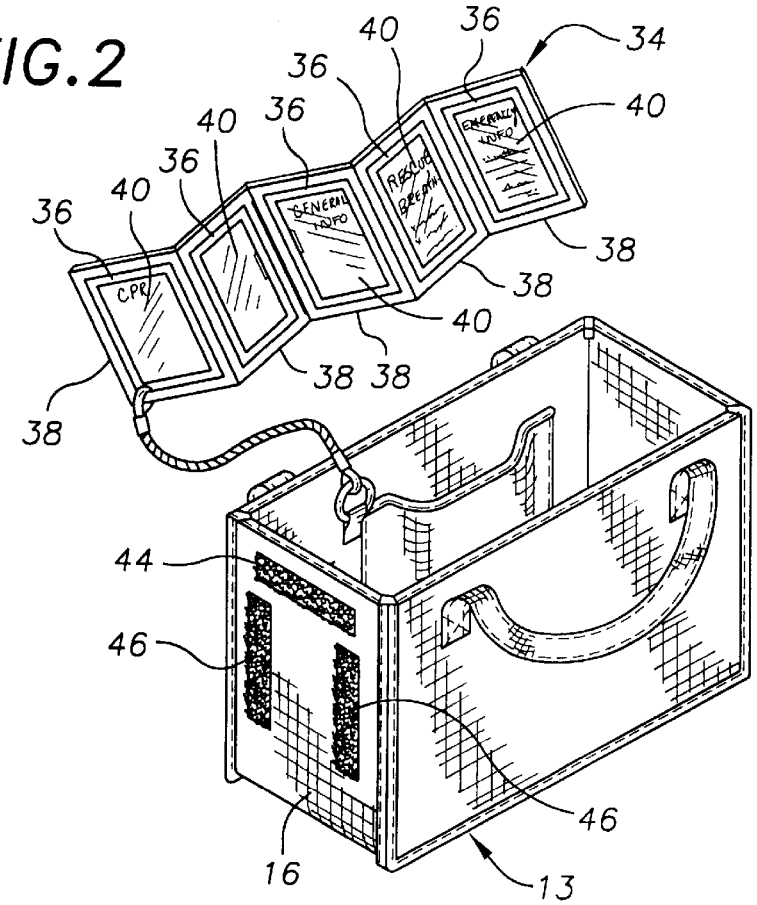
FIG. 2 is a perspective view of the primary bag assembly of the infant carry bag of FIG. 1 in isolation showing the top and two side edge carry bag fastener strips; the accordion fold safety card folder removed from one safety card storage pocket; the accordion fold safety card folder secured to the primary carry bag with the flexible safety card tether; a number of safety instruction/first-aid cards positioned within the sleeves of the safety card accordion folder; and the hook and pile fastener strips on the edges of the safety card accordion folder.

Primary bag assembly 12 also includes a flexible safety card tether, generally designated 32; an accordion fold safety card folder, generally designated 34 and a number of safety/first-aid cards 36 (FIG. 2). In this embodiment, flexible safety card tether 32 is a length of nylon cord that is secured between accordion fold safety card folder 34 and the interior surface of one of the two side wall pane's 18.

With reference to FIG. 2, accordion fold safety card folder 34 is provided with five foldable segments 38, each foldable segment 38 being provided with identical transparent front and rear sleeves 40. A safety/first-aid card 36 is positioned within each one of the front and rear sleeves 40. Safety/first-aid cards 36 include a number of procedure card members and an information care member. Safety/first-aid cards 36 are constructed of a heavy card stock and are laminated to resist bending, tearing, fading and damage from spilled liquids. Safety cards/first-aid cards 36 are each sized to fit within a front or rear sleeve 40.

In this embodiment, diaper bag 13 has a top and two side edge carry bag fastener strips 44,46, respectively, of hook and pile fastener material provided on the exterior of one of the opposed end wall panels 16. Top and two side edge carry bag fastener strips 44,46 are used as a fastening mechanism for securing detachable formula case 14 (FIG. 1) to diaper bag 13.

Figure 3:
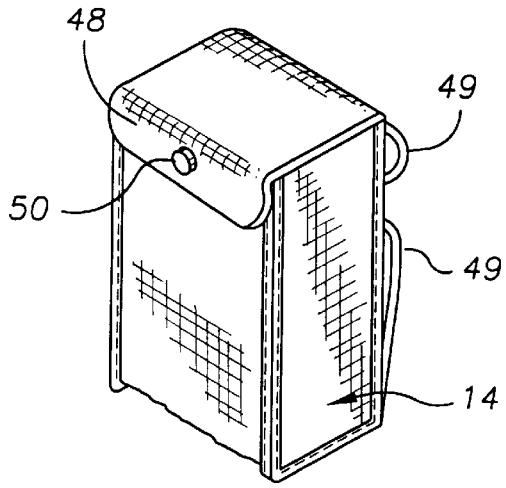
FIG. 3 is a perspective view of the exemplary detachable formula case of FIG. 1 in isolation showing the top edge case fastener strip, one of the two side edge case fastener strips, and the case cover flap secured in place with the cover snap.

With reference now to FIG. 3, detachable formula case 14 is of stitched canvas construction, includes a case cover flap 48 that is securable in a closed configuration with a cover snap fastener 50, and is provided with three case fastener strips 49 (only two shown, third one shown in FIG. 6) that are securable on to carry bag fastener strips 44,46 (FIG. 2).

Figure 4:
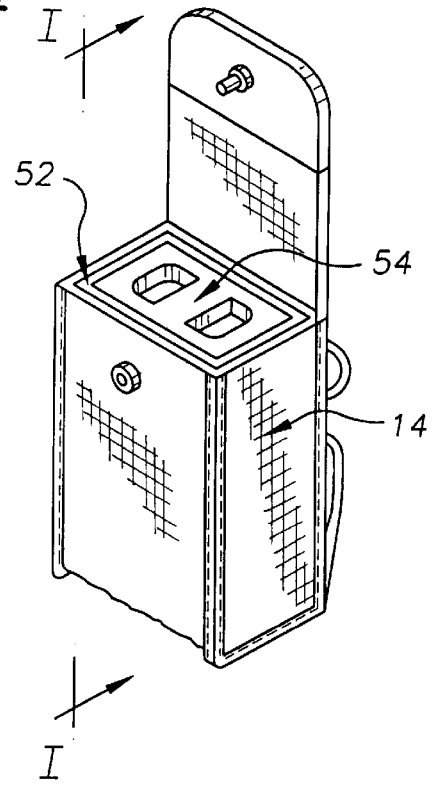
FIG. 4 is a perspective view of the detachable formula case in isolation showing the case cover flap folded into the open position to show the top section of the removable anti-bacterial formula bottle enclosure.

With reference now to FIG. 4, detachable formula case 14 defines a formula enclosure receiving chamber 52 that is sized to receive a removable anti-bacterial formula bottle enclosure, generally designated 54.

Figure 5:
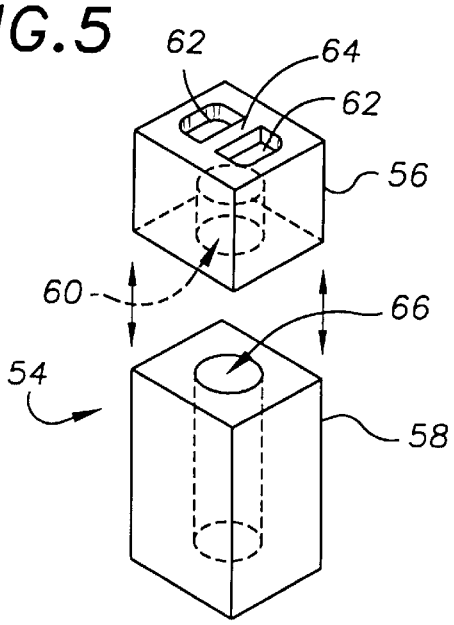
FIG. 5 is an exploded perspective view of the removable anti-bacterial formula bottle enclosure showing the top section including the cylinder shaped top receiving cavity and the two finger indentations that define the handle of the top section; and the bottom section of the removable anti-bacterial formula bottle enclosure including the bottom receiving cavity.
Figure 6:
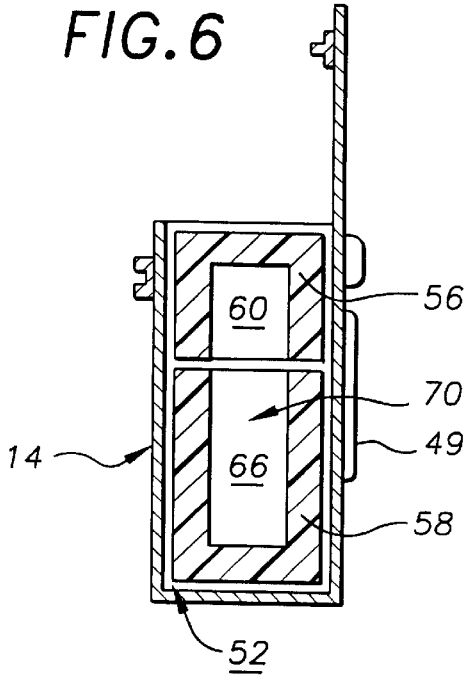
FIG. 6 is cross sectional view of the detachable Formula case along the line I—I of FIG. 4 showing the case cover flap folded into the open position; the horizontal fastener strip; the other one of the two vertical fastener strips; the formula enclosure receiving chamber formed within the formula case; the top section of the removable anti-bacterial formula enclosure including the cylinder shaped top receiving cavity; and the bottom section or the removable anti-bacterial formula enclosure with the bottom receiving cavity.

With reference now to FIG. 5, removable anti-bacterial formula bottle enclosure 54 includes a top section 56 and a bottom section 58 that are each constructed from rectangular shaped blocks of anti-bacterial plastic such as is used commonly to construct chopping boards. Top section 56 has a cylinder shaped top receiving cavity 60 (also shown in FIG. 6), two finger indentations 62, and a handle 64. Bottom section 58 has a bottom receiving cavity 66. With reference to FIG. 6, top receiving cavity 60 and bottom receiving cavity 66 are positioned in a manner such that, when top section 56 and bottom section 58 are positioned within formula enclosure receiving chamber 52 of detachable formula case 14, top receiving cavity 60 and bottom receiving cavity 66 form a combined formula receiving cavity 70 sized to hold at least one conventional baby bottle (not shown).

FIG. 7 shows a second exemplary embodiment of the infant care bag of the present invention generally designated by the designation 10A. In this embodiment, infant care bag 10A includes two detachable formula cases 14, instead of only one, and a primary bag assembly 12A that is identical to primary bag assembly 12 (FIG. 2) except primary bag assembly 12A includes top and two side edge carry bag fastener strips 44,46 (FIG. 2) on the exterior of each of the opposed end wall panels 16.

It can be seen from the preceding description that a device for infant care which has a bag for carrying infant supplies, has a plurality of safety cards having emergency information printed thereon attached to the bag, has safety cards including a plurality of procedure card members having a first and second side, the first side of each card member having a first aid procedure printed thereon for an infant under the age of one year, and the second side of each procedure card member having a first aid procedure printed thereon for a child between the age of one year and eight years, and has safety cards including an information card member having a first and second side surfaced for writing thereon information pertinent for the child's care has been provided.

It can be seen from the preceding description that an infant care bag has been provided that includes a primary bag assembly bag for carrying infant supplies; that has a plurality of safety cards having emergency information printed thereon attached to the bag; that has safety cards including a plurality of procedure card members having a first and second side, the first side of each procedure card member having a first aid procedure printed thereon for an infant under the age of one year, and the second side of each procedure card member having a first aid procedure printed thereon for a child between the age of one year and eight years; that includes an information card having a first and second side surfaced for writing thereon information pertinent for the child's care; that includes a diaper compartment as well as an anti-bacterial formula enclosure constructed from an anti-bacterial plastic, the formula enclosure having a cavity within which a supply of infant formula can be positioned; and that includes a primary bag assembly and at least one detachable formula case assembly that is detachably securable to the primary bag assembly; the primary bag assembly including a diaper bag, an accordion fold safety card folder, a number of safety instruction/first-aid cards and a flexible safety card tether; the diaper bag including handles, a diaper compartment and a safety card storage pocket formed therein; the accordion fold safety card folder being sized to fit within the safety card storage pocket when in a folded configuration and including a number of safety card sleeves sized to receive therein one of the number of safety instruction/first-aid cards; each of the safety instruction/first-aid cards being positioned within a safety card sleeve of the accordion fold safety card folder; the flexible safety card tether being secured between the accordion fold safety card folder and the diaper bag; the at least one detachable formula case assembly being detachably securable to the diaper bag; each detachable formula case assembly having a case member and a removable anti-bacterial formula bottle enclosure; the case member defining a formula enclosure receiving chamber and having a case cover flap positionable in a manner to block access into the formula enclosure receiving chamber; the removable anti-bacterial formula bottle enclosure being constructed from an anti-bacterial plastic and sized to fit within the formula enclosure receiving chamber of the detachable formula case; the anti-bacterial formula enclosure including a top section and a bottom section; the top section including a cylinder shaped top receiving cavity and two finger indentations that define a handle of the top section; the bottom section of the removable anti-bacterial formula bottle enclosure including a cylinder shaped bottom receiving cavity.

It is noted that the embodiment of the infant care bag described herein in detail for exemplary purposes is of course subject to many different variations in stricture, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An infant care bag comprising:

primary bag assembly; and at least one detachable formula case assembly that is detachably securable to said primary bag assembly;

said primary bag assembly including a diaper bag, an accordion fold safety care folder, a number of safety instruction/first-aid cards and a flexible safety card tether;

said diaper bag including handles, a diaper compartment and a safety card storage pocket formed therein;

said accordion fold safety card folder being sized to fit within said safety card storage pocket when in a folded configuration and including a number of safety card sleeves sized to receive therein one of said number of safety instruction/first-aid cards;

each of said safety instruction/first-aid cards being positioned within a safety card sleeve of said accordion fold safety card folder;

said flexible safety card tether being secured between said accordion foil safety card folder and said diaper bag;

said at least one detachable formula case assembly being detachably securable to said diaper bag;

each detachable formula case assembly having a case member and a removable anti-bacterial formula bottle enclosure;

said case member defining a formula enclosure receiving chamber and having a case cover flap positionable in a manner to block access into said formula enclosure receiving chamber;

said removable anti-bacterial formula bottle enclosure being constructed from an anti-bacterial plastic and sized to fit within said formula enclosure receiving chamber of said detachable formula case;

said anti-bacterial formula enclosure including a top section and a bottom section;

said top section including a top receiving cavity;

said bottom section of said removable anti-bacterial formula bottle enclosure including a bottom receiving cavity.

2. The infant care bag of claim 1, wherein:

said top section further includes a handle.

3. The infant care bag of claim 2, further including:

said handle of said top section is define by two finger indentations.

4. The infant care bag of claim 1, wherein:

said top receiving cavity of said top section is cylinder shaped.

5. The infant care bag of claim 1, wherein:

said bottom receiving cavity of said bottom section of said removable anti-bacterial formula bottle enclosure is cylinder shaped.

6. The infant care bag of claim 1, wherein:

said primary bag assembly further includes at least one carry bag fastener strip of hook and pile fastener material; and said at least one detachable formula case includes at least one case fastener strip of hook and pile material; and wherein said at least one detachable formula case assembly is detachably securable to said primary bag assembly by contacting said at least one carry bag fastener strip with said at least one case fastener strip.

7. The infant care bag of claim 2, wherein:

said top receiving cavity of said top section is cylinder shaped.

8. The infant care bag of claim 2, wherein:

said bottom receiving cavity of said bottom section of said removable anti-bacterial formula bottle enclosure is cylinder shaped.

9. The infant care bag of claim 2, wherein:

said primary bag assembly further includes at least one carry bag fastener strip of hook and pile fastener material; and said at least one detachable formula case includes at least one case fastener strip of hook and pile material; and wherein said at least one detachable formula case assembly is detachably securable to said primary bag assembly by contacting said at least one carry bag fastener strip with said at least one case fastener strip.

10. The infant care bag of claim 7, wherein:

said bottom receiving cavity of said bottom section of said removable anti-bacterial formula bottle enclosure is cylinder shaped.

11. The infant care bag of claim 7, wherein:

said primary bag assembly further includes at least one carry bag fastener strip of hook and pile fastener material; and said at least one detachable formula case includes at least one case fastener strip of hook and pile material; and wherein said al least one detachable formula case assembly is detachably securable to said primary bag assembly by contacting said at least one carry bag fastener strip with said at least one case fastener strip.

12. The infant care bag of claim 10, wherein:

said primary bag assembly further includes at least one carry bag fastener strip of hook and pile fastener material; and said at least one detachable formula case includes at least one case fastener strip of hook and pile material; and wherein said at least one detachable formula case assembly is detachably securable to said primary bag assembly by contacting said at least one carry bag fastener strip with said at least one case fastener strip.

13. The infant care bag of claim 8, wherein:

said primary bag assembly further includes at least one carry bag fastener strip of hook and pile fastener material; and said at least one detachable formula case includes at least one case fastener strip of hook and pile material; and wherein said at least one detachable formula case assembly is detachably securable to said primary bag assembly by contacting said at least one carry bag fastener strip with said at least one case fastener strip.

14. The infant care bag of claim 3, wherein:

said top receiving cavity of said top section is cylinder shaped.

15. The infant care bag of claim 3, wherein:

said bottom receiving cavity of said bottom section of said removable anti-bacterial formula bottle enclosure is cylinder shaped.

16. The infant care bag of claim 3, wherein:

said primary bag assembly further includes at least one carry bag fastener strip of hook and pile fastener material; and said at least one detachable formula case includes at least one case fastener strip of hook and pile material; and wherein.

said at least one detachable formula case assembly is detachably securable to said primary bag assembly by contacting said at least one carry bag fastener strip with said at least one case fastener strip.

17. The infant care bag of claim 14, wherein:

said bottom receiving cavity of said bottom section of said removable anti-bacterial, formula bottle enclosure is cylinder shaped.

18. The infant care bag of claim 14, wherein:

said primary bag assembly further includes at least one carry bag fastener strip of hook and pile fastener material; and said at least one detachable formula case includes at least one case fastener strip of hook and pile material; and wherein said at least one detachable formula case assembly is detachably securable to said primary bag assembly by contacting said at least one carry bag fastener strip with said at least one case fastener strip.

19. The infant care bag of claim 4, wherein:

said bottom receiving cavity of said bottom section of said removable anti-bacterial formula bottle enclosure is cylinder shaped.

20. The infant care bag of claim 4, wherein:

said primary bag assembly further includes at least one carry bag fastener strip of hook and pile fastener material; and said at least one detachable formula case includes at least one case fastener strip of hook and pile material; and wherein said at least one detachable formula case assembly is detachably securable to said primary bag assembly by contacting said at least one carry bag fastener strip with said at least one case fastener strip.

* * * * *